US011613888B2

(12) United States Patent
Van Rijsingen

(10) Patent No.: US 11,613,888 B2
(45) Date of Patent: Mar. 28, 2023

(54) METHOD AND MEANS FOR MAKING A WALL BY MEANS OF SECURING DRYWALL PANELS TO A BACKGROUND

(71) Applicants: RIPSTAAL B.V., Oss (NL); Wilhelmus Matheus Maria Van Rijsingen, Oss (NL)

(72) Inventor: Wilhelmus Matheus Maria Van Rijsingen, Oirschot (NL)

(73) Assignees: RIPSTAAL B.V., Oss (NL); Wilhelmus Matheus Maria Van Rijsingen, Oirschot (NL)

( * ) Notice: Subject to any disclaimer, the term of this patent is extended or adjusted under 35 U.S.C. 154(b) by 0 days.

(21) Appl. No.: 17/257,773

(22) PCT Filed: Jul. 4, 2019

(86) PCT No.: PCT/NL2019/050413
§ 371 (c)(1),
(2) Date: Jan. 4, 2021

(87) PCT Pub. No.: WO2020/009576
PCT Pub. Date: Jan. 9, 2020

(65) Prior Publication Data

US 2021/0293016 A1 Sep. 23, 2021

(30) Foreign Application Priority Data

Jul. 5, 2018 (NL) ..... 1042927
Jan. 10, 2019 (NL) ..... 1043116
(Continued)

(51) Int. Cl.

| | |
|---|---|
| ***E04B 1/61*** | (2006.01) |
| ***E04B 2/72*** | (2006.01) |
| ***E04C 2/04*** | (2006.01) |
| ***E04F 13/08*** | (2006.01) |

(52) U.S. Cl.
CPC ..... *E04B 1/6137* (2013.01); *E04B 2/721* (2013.01); *E04C 2/043* (2013.01);
(Continued)

(58) Field of Classification Search
CPC ..... E04B 1/6137; E04B 2/721; E04C 2/043; E04F 13/0819
See application file for complete search history.

(56) References Cited

U.S. PATENT DOCUMENTS 1,584,148 A * 5/1926 Schumacher ..... E04C 2/043 428/125
1,672,099 A * 6/1928 Schumacher ..... E04C 2/043 428/119
(Continued)

FOREIGN PATENT DOCUMENTS

GB 425607 A * 3/1935 ..... E04B 1/6141
GB 2481126 A * 12/2011 ..... E04B 2/08
KR 20150087535 A * 7/2015

*Primary Examiner* — Babajide A Demuren
(74) *Attorney, Agent, or Firm* — Maschoff Brennan

(57) ABSTRACT

A wall is made with the aid of drywall panels and a background. The drywall panels are provided with edge coupling profiles on their edges, which are arranged to be secured to the background and, subsequently, coupled to each other. The drywall panels may also be provided with a rear coupling profile. The drywall panels can be hooked together or coupled to each other by means of transverse sliding. The edge coupling profiles may also comprise anti-adhesive extensions, forming anti-adhesive edge areas at the front side of the drywall panel on which stucco mass does not adhere. The measures according to the invention are intended to provide drywall panels which, after use, can be disassembled easily and cleanly so that the drywall panels can be reused as drywall panels, resulting in that the environment is not burdened with gypsum waste caused by damaged, broken and destroyed drywall panels.

10 Claims, 7 Drawing Sheets

(30) Foreign Application Priority Data

Jan. 21, 2019 (NL) ..... 1043125
Jan. 21, 2019 (NL) ..... 1043126

(52) U.S. Cl.
CPC ..... *E04F 13/0819* (2013.01); *E04B 2103/02* (2013.01); *E04F 2201/0153* (2013.01); *E04F 2201/05* (2013.01)

(56) References Cited

U.S. PATENT DOCUMENTS 1,854,396 A * 4/1932 Davis ..... E04C 2/043 52/483.1
1,900,805 A * 3/1933 Davis ..... E04C 2/043 52/601
2,015,744 A * 10/1935 Davis ..... E04C 2/043 52/250
2,021,922 A * 11/1935 Peck ..... E04C 2/043 52/601
2,082,314 A * 6/1937 Venzie ..... E04F 13/0812 52/506.09
2,891,638 A * 6/1959 Grundy ..... F16B 5/0012 52/578
4,467,578 A * 8/1984 Weinar ..... E04B 2/7457 52/281
5,373,678 A * 12/1994 Hesser ..... E04C 2/292 52/309.2
10,927,542 B2 * 2/2021 St. Germain ..... E04B 1/68
2017/0268232 A1 * 9/2017 Renke ..... E04B 2/707

* cited by examiner

METHOD AND MEANS FOR MAKING A WALL BY MEANS OF SECURING DRYWALL PANELS TO A BACKGROUND

The invention relates to a method and means for securing drywall panels to a (supporting) background.

It is an object of the present invention to provide an improved method for applying drywall panels (see, for example, https://en.wikipedia.org/wiki/drywall) to a background, for example constituted by a couple of upright elements (stands) or by a flat background, such that, for example in case of changes in the layout or partly or complete demolition of a building comprising drywalls, the individual drywall panels can be properly removed from their background, such that those drywall panels can subsequently be reused, instead of—as is standard practice today—be disposed as (gypsum) waste. The object of the invention is therefore to make a substantial contribution to reduction of the amount of (gypsum) waste.

The invention provides a method for securing drywall panels to a background, comprising, as a provisioning step:

providing drywall panels which are provided on their edges with edge coupling profiles, i.e. at one edge a first edge coupling profile having a securing (or mounting) extension (for example a securing or mounting slab or strip) which is intended and arranged to secure (or to mount) the drywall panels to a background, for example by means of screws, and on the other edge of the same drywall panel a second edge coupling profile, wherein the edge coupling profiles are provided with coupling means which are arranged to intercouple the second edge coupling profile of a drywall panel and the first edge coupling profile of a drywall panel previously secured to a background in a manually releasable or detachable way.

The method further comprises, as execution steps:

(a) securing a first drywall panel provided with said edge coupling profiles against a background, the first edge coupling profile of said drywall panel being secured with its securing extension to the background, for example screwed, (b) coupling a second drywall panel with its second edge coupling profile to the first edge coupling profile of the first drywall panel (already secured to the background), (c) subsequently securing said second drywall panel by securing (by screwing, for example) the securing extension of the first edge coupling profile of said second drywall panel to the background.

In the same way further drywall panels, provided on their edges with first and second edge coupling profiles as indicated above, can then be secured to the background.

Thus, according to the invention, use is made of drywall panels which are provided with edge coupling profiles on their edges, wherein then, preferably, always a drywall panel is secured (for example screwed) with its first (screw) profile to the background, and then a subsequent drywall panel is coupled, with its (coupling) profile, to the already secured edge coupling profile of the first drywall panel.

In a first embodiment (illustrated in the accompanying FIG. 1), this method of coupling drywall panels may, to some extent, be compared with laying floor laminate, where the parts are coupled to each other by hooking or "snapping" ("click laminate"). In another embodiment of the present invention (illustrated in the other figures), this method of coupling drywall panels may be compared, to some extent, with the installation of floor parts or (wall) sheets which are provided with tongue and groove, where the parts are coupled to each other by means of sliding the tongue of one part into the groove of the neighbouring part in transverse direction.

By "able to couple (or connect or engage) to each other (or interconnect) at a manually releasable or detachable way" or simply "releasably" or "detachably" is, in the context of the present invention, meant that the drywall panels can be coupled (or connected or engaged) to or in each other during mounting of a wall by means of the edge coupling profiles, but later—for example during renovation or demolition—can also be uncoupled again easily, either manually or using only simple tools, without having to damage or break the drywall panels, in the same way as can be done with, for example, laminate with hook or snap profiles and with floorboards and scraps provided with brasses and grooves.

Drywall panels arranged for carrying out the method according to the invention must therefore be provided at both edges with edge coupling profiles, i.e. at one edge a first edge coupling profile having a securing extension which is intended and arranged to be secured to a background (fixed for example by means of screws), and at the other edge a second edge coupling profile, wherein the edge coupling profiles are provided with coupling means which are arranged to be able to interconnect the second edge coupling profile of a drywall panel and the first edge coupling profile of a drywall panel previously secured to a background in a manually detachable way.

In the production of the drywall panel according to the invention, the first and second edge coupling profile are preferably arranged, at least partly, by gluing of the profiles to the edges of the drywall panel. Most types of drywall panels are provided with a protective layer on both surfaces (usually made of paper or thin cardboard). In approximately the same way as in a previous patent application of applicant (EP330797) it is proposed to apply a (different kind of) edge coupling profile against the edges of the drywall panels, also in this case the edge coupling profiles are, preferably, at least partially fixed to the edges of the drywall panels by gluing to inwardly folded edge strips of those two protective layers.

The invention comprises (a) the method as indicated above, (b) drywall panels arranged to perform that method (i.e. by the edge coupling profiles arranged on the edges), while the scope of protection of the invention further comprises (c) any edge coupling profile intended and arranged (formed, for example by means of extrusion) as a first or second edge coupling profile for drywall panels according to the invention, as described above and/or indicated in the appended claims resp.

The drywall panels according to the invention can therefore, as indicated above, be provided with edge coupling profiles which can be hooked into each other by means of a hooking movement for the purpose of coupling to each other (comparative to click laminate) or which can be interconnected by displacement in transverse direction or sliding (used for interconnecting floor parts etc. provided with tongues and grooves).

The first embodiment, with hooked edge coupling profiles, is part of an earlier (priority) patent application of applicant, NL1042927, filed on May 7, 2018, while the second embodiment, with sliding edge coupling profiles, forms part of a second earlier (priority) patent application of applicant, NL1043116, filed on Jan. 1, 2019. In the latter application, measures are also proposed for being able to fasten/couple wider drywall panels to a background, not only on their edges, but also in between them. In the present application, in addition to the versions of drywall panels with edge coupling profiles already described in said earlier (priority) applications, furthermore, embodiments are proposed which are important for the use of walls with double layers of drywall panels.

Finally, the drywall panels may, preferably, be provided with edge coupling profiles which are, in addition to being arranged for coupling adjacent drywall panels and/or arranged for attaching the drywall panels to a background, also provided with anti-adhesive extensions, each forming an anti-adhesive edge area on the front side of the relevant drywall panel, comprising a surface on which stucco does not adhere, which option is part of a third earlier (priority) patent application, NL1043126, filed by the applicant on 21 Jan. 2019. The anti-adhesive edge areas formed by those anti-adhesion extensions serve to ensure that the (edge) areas on either sides of the seam between two adjacent drywall panels can be plastered evenly flat, while however preventing that the applied stucco layer affects the correct functioning of the (simple, manually detachable) coupling and/or securing means (i.e. the edge coupling profiles etc.) and/or destroys their accessibility, as a result of which the drywall panels would no longer be fit to be uncoupled and/or unscrewed in a normal, "clean" way, causing that the drywall panels would (have to) be broken or at least damaged and hence becoming not more reusable.

The invention will now be further discussed with reference to the figure description below.

Figure 1:
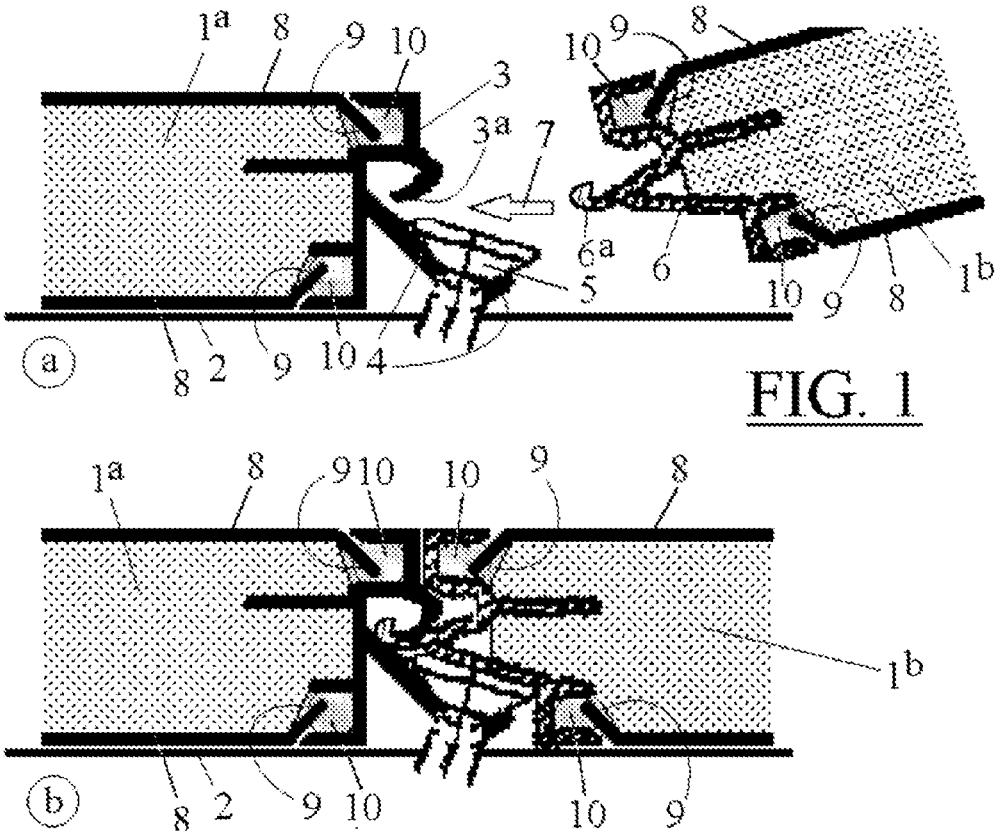
FIG. 1 shows, in cross-section, parts of neighbouring drywall panels which are provided with a first exemplary embodiment of edge coupling profiles according to the invention, which can be hooked into each other.

FIG. 1 shows parts of two neighbouring drywall panels 1*a* and 1*b*, both of which are provided with two edge coupling profiles on their both edges, viz. a first edge coupling profile 3 at one edge having a securing extension 4 which is intended and arranged to be secured to a base or background 2, for example by means of screws 5, and at the other edge a second edge coupling profile 6 (without securing extension 4).

In the figure, only the long right-hand edge of one drywall panel 1*a* (in cross-section) is drawn and the long left-hand edge of the other drywall panel 1*b*, illustrating that both drywall panels 1*a* and 1*b* are mounted edge by edge to the background 2 using the edge coupling profiles 3 and 6.

The edge coupling profiles 3 and 6 are shaped and arranged such that the second edge coupling profile 6 of the drywall panel 1*b* and the first edge coupling profile 3 of the drywall panel 1*a* previously secured by means of screws 5 to the background 2, can be coupled to each other, see movement arrow 7, i.e. hooked or clicked together, comparable to the way click laminate is hooked/clicked together.

The first and second edge coupling profiles 3 and 6 resp. have been mounted in the factory (at least partly) by gluing the profiles to the edges of the drywall panels. The drywall panels 1*a* and 1*b* shown in the figure are provided with a protective layer 8 (usually made of paper or thin cardboard) on both surfaces (i.e. below and above), the first and second edge coupling profiles 3 and 6 respectively are mounted, at least partly, by gluing the profiles to inwardly folded edge strips 9 of these two protective layers 8. Said edge strips 9 are folded inwardly after, in the factory, for example by means of milling, the plaster (gypsum) material behind/underneath the strips 9 has been removed from the drywall panels 1*a* and 1*b*, after which the strips 9 are pressed inwardly. The channels created by removal of the gypsum material serve to receive the strips 9 pressed inwardly. Before or during the mounting of the edge coupling profiles 3 and 6 resp. to the edges of the drywall panels, those channels are largely filled with glue 10, so that, after the glue 10 has hardened, a close connection is formed between the relevant edge coupling profiles 3 and 6 resp. and the paper/cardboard strips 9. With this connection technique, which has been proposed for the first time in the above-mentioned prior patent application EP330797 in the name of the applicant, an excellent connection and adhesion is constituted between the edge coupling profiles 3 and 6 resp. and the end surfaces of the edges of the drywall panels 1*a* and 1*b*.

Coupling of both drywall panels 1*a* and 1*b* thus takes place after the drywall panel 1*a* has been secured to the background 2 by means of its securing extension 4 by means of screws 5, after which the drywall panel 1*b* (see arrow 7) with its second edge coupling profile 6 is attached to/in first edge coupling profile 3 of the first drywall panel 1*a* by hooking or clicking, i.e. in that (in the exemplary embodiment shown) a coupling edge 6*a* of the second edge coupling profile 6 is hooked behind a coupling edge 3*a* of the first edge coupling profile 3.

The method for applying drywall panels according to the invention to a background thus comprises the following steps:

I. Providing—as a preparatory (provisioning) step—drywall panels 1*a* and 1*b* which are provided with edge coupling profiles 3 and 6 resp. on their edges, i.e. at one edge a first edge coupling profile 3 having a securing extension 4 which is intended and arranged to engage (i.e. to be engaged, secured) to a background 2, for example by means of screws 5, and on the other edge of the same drywall panel 1*a* resp. 1*b* a second edge coupling profile 6 (without securing extension 4). The edge coupling profiles comprise coupling means whereby the second edge coupling profile 6 of a drywall panel 1*b* and the first edge coupling profile 3 of a drywall panel 1*a* previously secured (for example screwed) to a background 2 can be coupled to each other.

II. Performing the following steps:

(a) securing a first drywall panel 1*a* to a background 2, wherein the first edge coupling profile 3 with its securing extension 4 is secured to the background 2;

(b) coupling a second drywall panel 1*b* with its second edge coupling profile 6 to the first edge coupling profile 3 of the (already secured) first drywall panel 1*a* and subsequently securing said second drywall panel 1*b* by securing (for example screwing) the securing extension of the first edge coupling profile (not shown in FIG. 1) of said second drywall panel 1*b* to the background 2;

III. The (optional) subsequent securing of further drywall panels in the same manner with edge coupling profiles 3 and 6.

Figure 2:
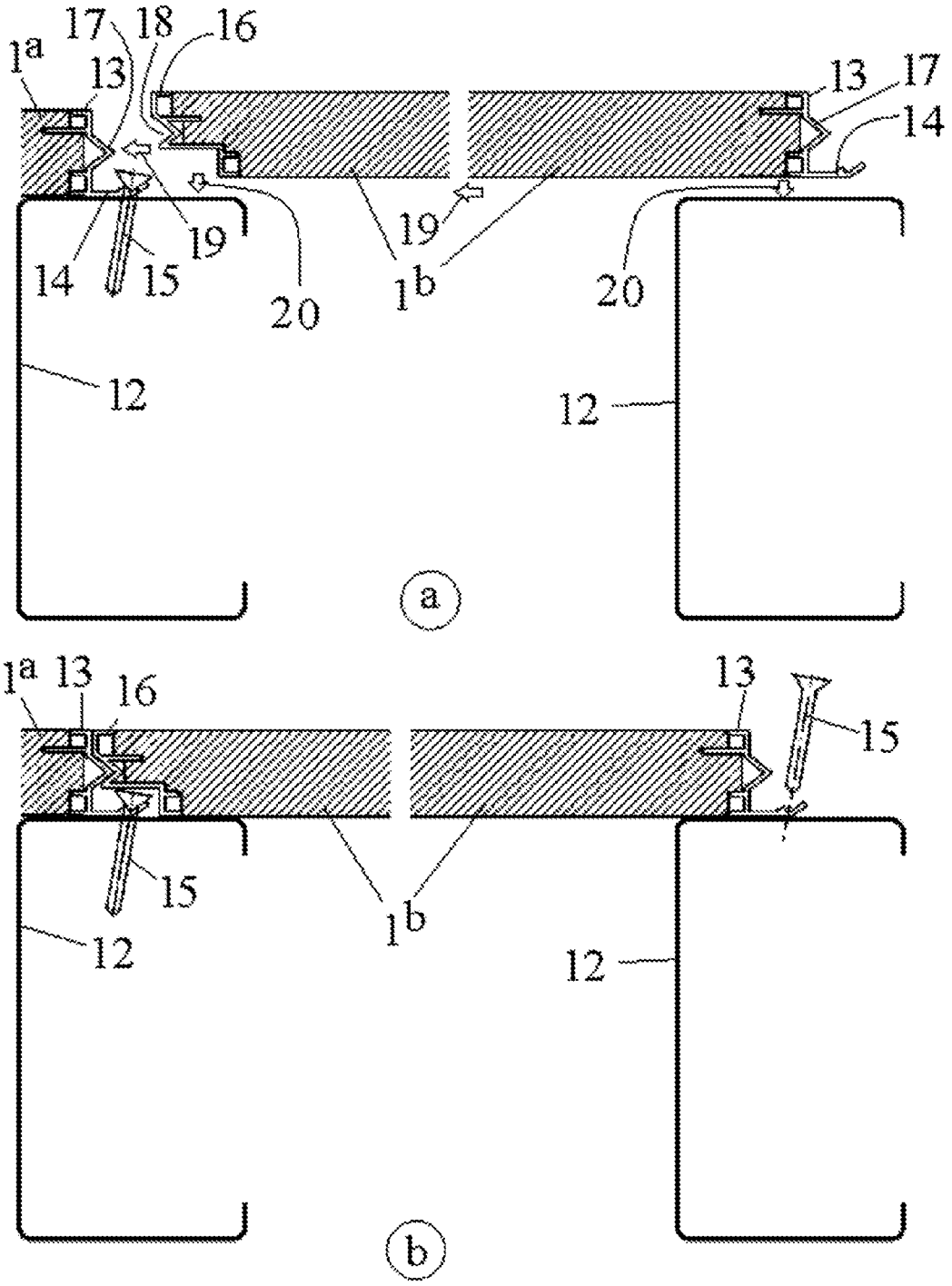
FIG. 2 shows, in cross-section, parts of neighbouring drywall panels which are provided with a second embodiment of edge coupling profiles according to the invention, which can be pushed (slid) into each other.

FIG. 2 shows, in cross-section, parts of neighbouring drywall panels which are provided with a second exemplary embodiment of edge coupling profiles according to the invention that can be pushed (slid) into each other. In FIG. 2, the (mounting) background (base or background 2 in FIG. 1) of the drywall panel is formed by a series of C-shaped profiled sheet steel upright elements 12 (two of which are shown in FIGS. 2*a* & 2*b*). The drywall panels 1*a* and 1*b* are provided at both edges with edge coupling profiles, i.e. at one edge a first edge coupling profile 13 having a securing extension 14 which is intended and arranged to be secured to the background 12 (left in the figure) by means of screws 15. A second edge coupling profile is located on the other edge of the same drywall panel. In FIG. 2, on the left, only the right-hand edge plus the first edge coupling profile 13 of drywall panel 1*a* is visible, which is screwed to the left (edge) upright element 12 by means of the securing extension 14. In addition, a second drywall panel 1*b* still to be mounted is visible, of which both edge coupling profiles 13 and 16 are visible. In this embodiment, the edge coupling profiles 13 and 16 comprise more or less "brass and groove"—like coupling means 17 and 18 resp. which are arranged to enable the second edge coupling profile 16 of the drywall panel 1*b* not yet secured to the upright elements 12, and the first edge coupling profile 13 of the drywall panel 1*a* previously secured to the edge upright element 12 (in a manually detachable way) to each other by means of displacement (i.e. by a sliding movement) of the drywall panel 1*b* in transverse direction (to the left), see arrows 19, after the drywall panel 1*b* has been pressed against the edge upright elements 12, see arrows 20. The result of pressing the drywall panel 1*b* against both edge upright elements 12 and then sliding (to the left) the drywall panel 1*b* in order to be secured to both edge upright elements 12 is shown in FIG. 1*b*. After both drywall panels 1*a* and 1*b* are thus secured relative to each other by means of the tongue-and-groove-shaped edge coupling profiles 17 and 18 of the edge coupling profiles 13 and 16 (see left edge of FIG. 2*b*), the securing extension 14 of the edge coupling profile 13 can then are screwed down, by (self-tapping sheet) screws 15, to the right-hand edge upright element 12 (see FIG. 2*b* on the right). Subsequently, in the same way, further drywall panels can be added to the wall to be made on the right-hand edge in the figure.

Figure 3:
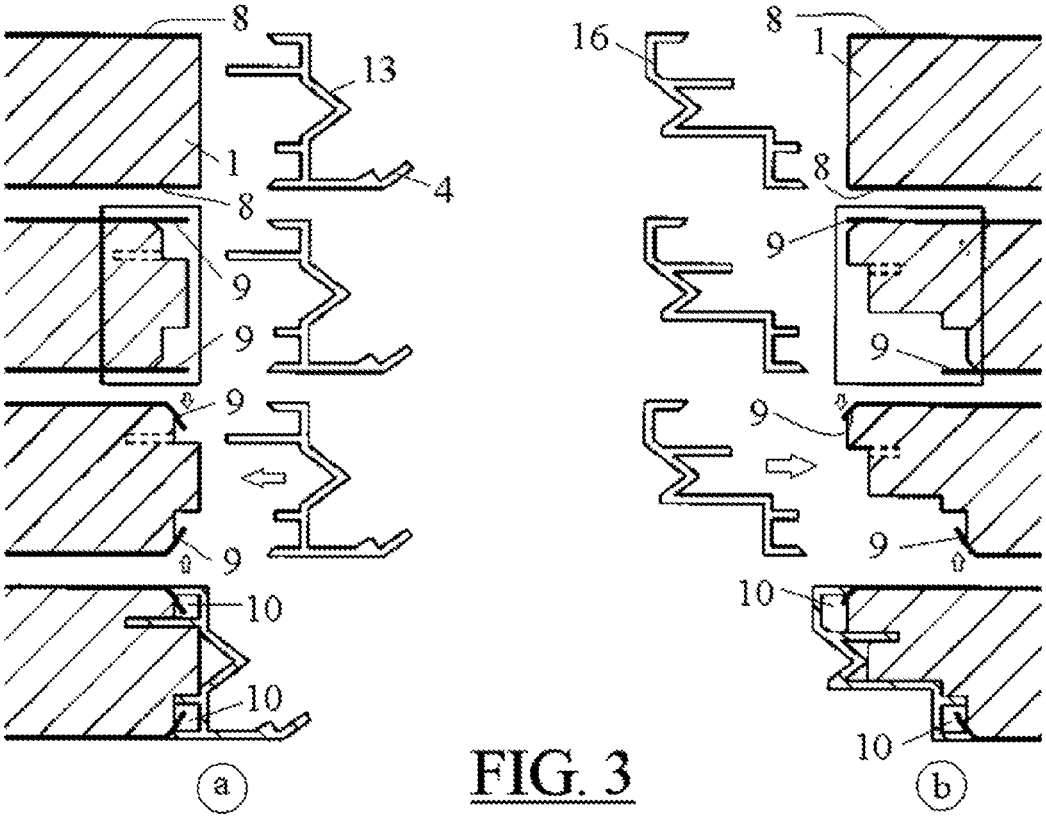
FIG. 3 shows in detail factory securing of edge coupling profiles shown in FIG. 2 to a drywall panel.

FIG. 3 shows once again explicitly how the first resp. second edge coupling profiles 13 resp. 16 are provided (in a factory) by gluing them against the edges of a drywall panel 1. The first and second edge coupling profiles 13 resp. 16 are applied by gluing them to inwardly folded edge strips of the two (usually paper) protective layers 8 of the drywall panel. During production, the short (long) edges of the drywall panel 1 are machined with specially profiled milling cutters, with which the gypsum stucco layer between the two protective layers 8 is partially removed, while furthermore a profiling is provided in the plaster that matches the shape of the ("male") first edge coupling profile 13 resp. the ("female") second edge coupling profile 16. After the edges of the drywall panels 1 have thus been profiled, the edge strips 9 (mechanically, for example by means of rollers) are folded inwardly (see arrows) and the edge coupling profiles 13 resp. 16 are pressed against the profiled end faces of the drywall panel 1, where they are solidly coupled to the rolled-in edge strips 9 by means of a previously applied glue layer 10. By gluing the edge coupling profiles 13 and 16 against the (paper) edge strips 9, a substantially better connection between the edge coupling profiles 13 and 16 on the one hand and the end face of the drywall panels 1 is obtained than when the edge coupling profiles 13 and 16 would have been glued (directly) against the gypsum stucco layer 1 between the protective paper layers 8, which, due to the structure of gypsum, would not provide reliable adhesion.

Figure 4:
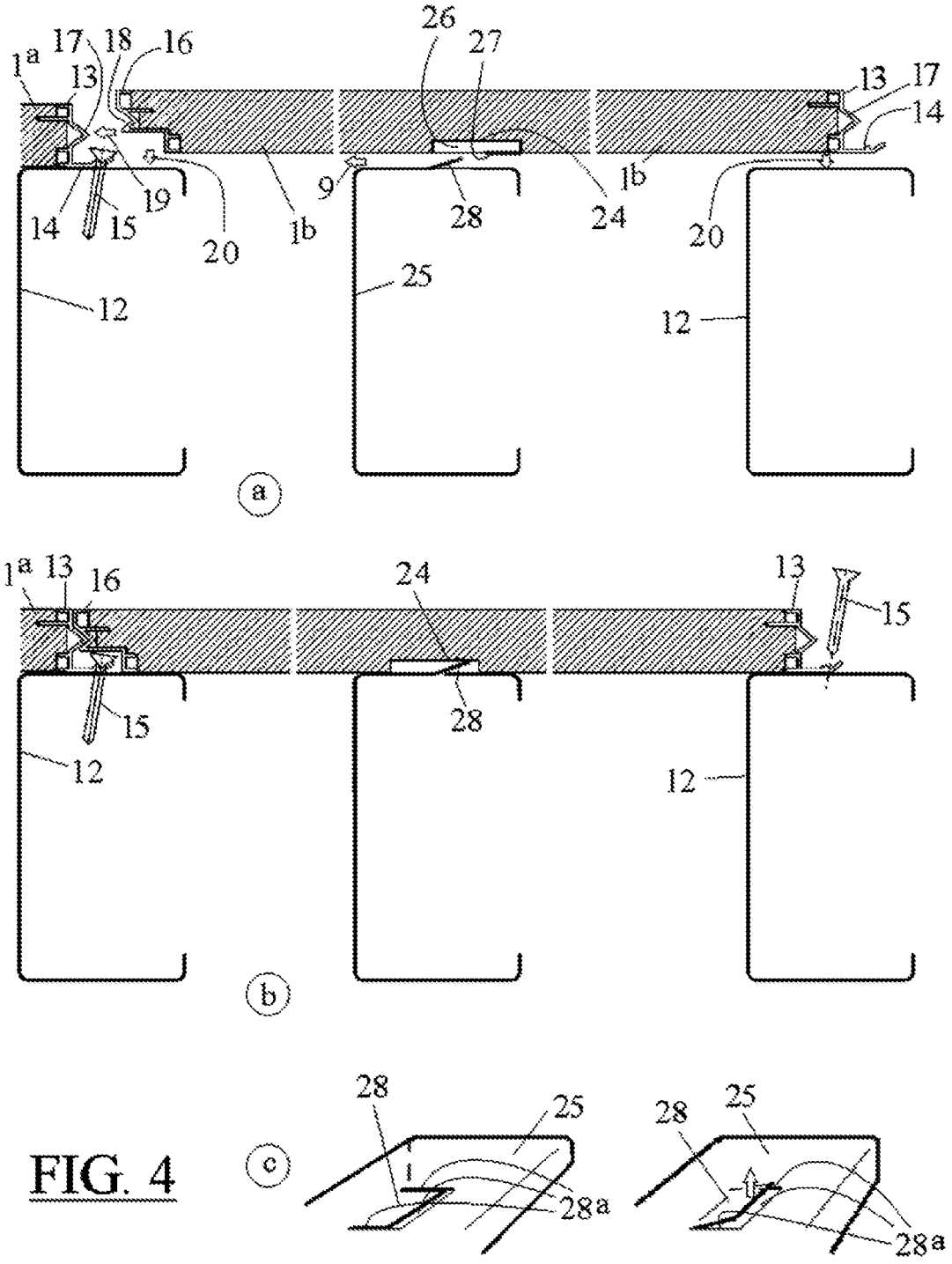
FIG. 4 shows, in cross-section, parts of neighbouring drywall panels provided with edge couplings shown in FIG. 2 and furthermore with a rear coupling of the drywall panels with the background, between the edge couplings.

FIG. 4 shows an exemplary embodiment of a drywall panel that is specifically arranged to perform a method according to the invention, in this case, however, with the use of a rear coupling 26-28 intended for use with wider drywall panels (e. g. 120 cm wide). As in FIG. 2, a drywall panel 1*a* (partially visible) and a drywall panel 1*b* are provided at both edges with edge coupling profiles, viz. on one edge a first edge coupling profile 13 with a securing extension 14 which is intended and arranged to be attached to upright elements 12 using screws 15, and on the other edge of the same drywall panel 1, a second edge coupling profile 16. The drywall panels 1*a* and 1*b* are further provided with a rear coupling profile embodiment 24 which is arranged also to engage with (i.e. to be engaged to) the background, that is, to engage with (to be engaged to) an additional (intermediate) upright element 25. The edge coupling profiles include, like in the embodiment of FIG. 2, coupling means 17 and 18 which are arranged to receive the second edge coupling profile 16 of a drywall panel 1*b*, and the first peripheral coupling profile 13 of a previously secured drywall sheet 12 to an edge upright element 12 (in a manually releasable way) by sliding (shifting, pushing) the relevant drywall panel in transverse direction (arrows 19). The rear coupling profile 24 and the upright element 25 are arranged to be coupled to each other by carrying out the same transverse movement of the drywall panel 1*b* in transverse direction (arrows 19), after the drywall panel 1*b* has first been pushed against the upright elements 12 and 25 (see arrows 20).

The rear coupling profile 24, arranged to be coupled to a suitable (middle) upright element 25, is provided with a shallow trench 26 recessed in the rear of the drywall panel 1*b*, extending parallel to the (course of the) edge coupling profiles 13 and 16 resp. The rear coupling profile 24 fixed in the slot 26 for example by gluing, comprises, in the embodiment shown, a more or less U-, V- or C-shaped edge coupling profile, having one or more coupling extensions 27, extending substantially in, or possibly within the rear surface of the drywall panel, inwardly into the slot 26, and arranged to engage, directly or indirectly, to or in a suitable upright element 25.

The upright element 25 in FIG. 4 is provided with one or more tabs 28 extending along the length of the upright element, which are arranged to engage to or in the rear coupling profile 24 of the drywall panel 1*b*. The upright element 25 may be made of (steel) sheet material while tabs 27 are provided in the sheet material during manufacture of the upright element 25 consisting of substantially U-, V- or C-shaped slots 28*a*, all shaped such that the sheet material 28 located between said U-, V- or C-shaped slots can be pressed of pulled out manually or with the aid of (i.e. using) a simple tool like e.g. a screwdriver, so as to provide the coupling extensions 27 to engage (in)to the rear coupling profile 24.

The edge upright elements 12, i.e. upright elements applied behind the edge areas of the drywall panels 1, and the intermediate upright elements 25, i.e. upright elements used behind the more inward, intermediate areas of the drywall panels 1 (not necessarily in the middle thereof) may, in practice, be completely identical: both "types" of upright elements 12 and 25 resp. may be provided with tabs 28, i.e. slots 28*a*, during manufacture, extending in the plane of the upright elements 12 and 25 resp. If an upright element is used as an "intermediate upright element" 25, intended to be coupled to the rear coupling profile 24 of a drywall panel, only the tabs 28 need to be jumped up, e.g. using a screwdriver, in order to be able to engage (in the oblique position) (in)to the rear coupling profile 24 of the relevant drywall panel 1.

Figure 5:
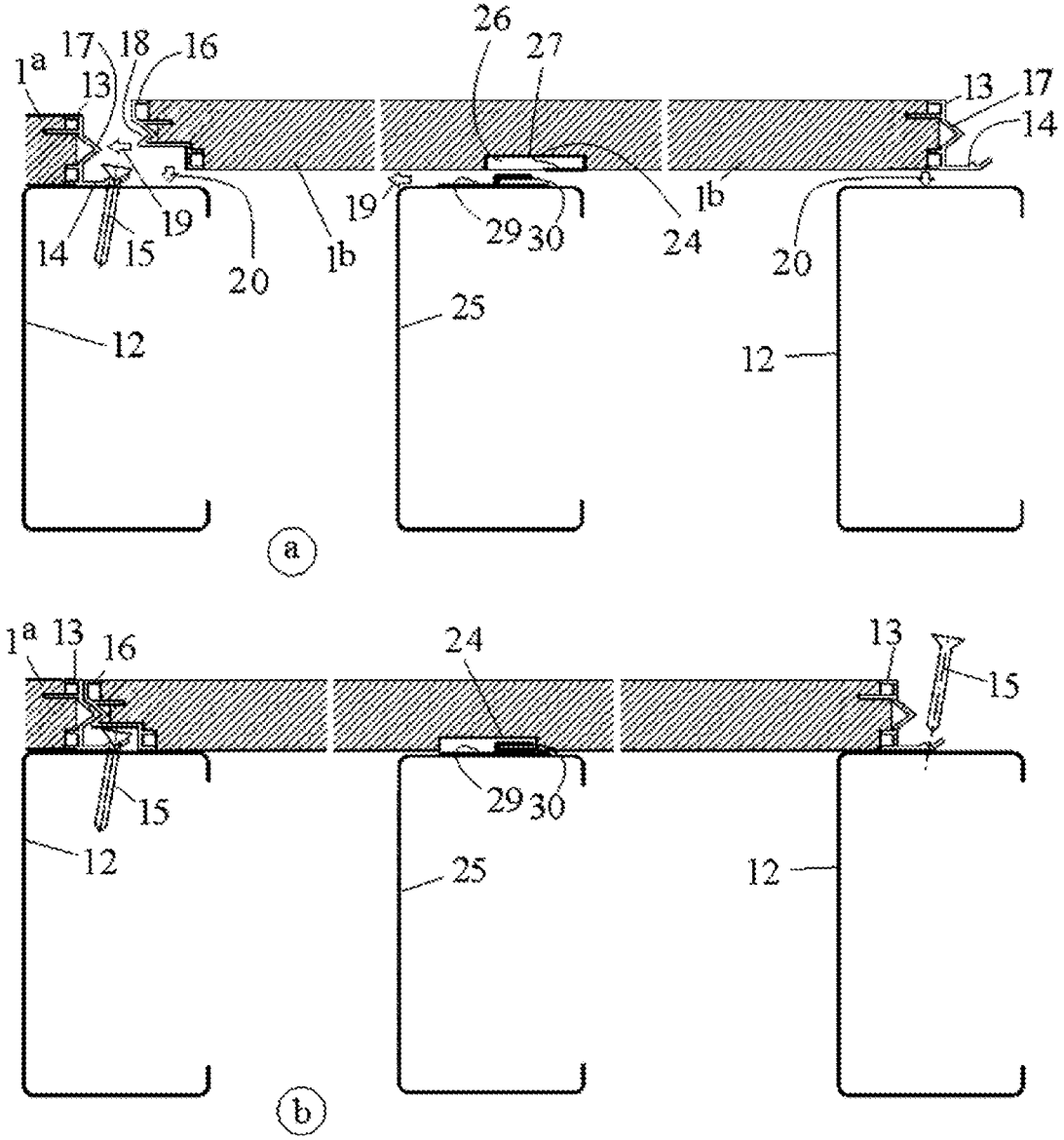
FIG. 5 shows the same configuration as FIG. 4, but with a slightly different rear coupling.

FIG. 5 shows the same configuration as FIG. 4, but with a somewhat differently arranged rear coupling which in this case comprises a coupling strip 29 which is applied (or has to be applied in advance) on the intermediate piece 25, for example by gluing. The coupling strip 29 is suitable and arranged by means of a coupling profile 30 to enable the drywall panel 1*b* to be coupled to the upright element 25 by means of a sliding movement 19 similar to that shown in FIG. 4 using tabs 28.

Figure 6:
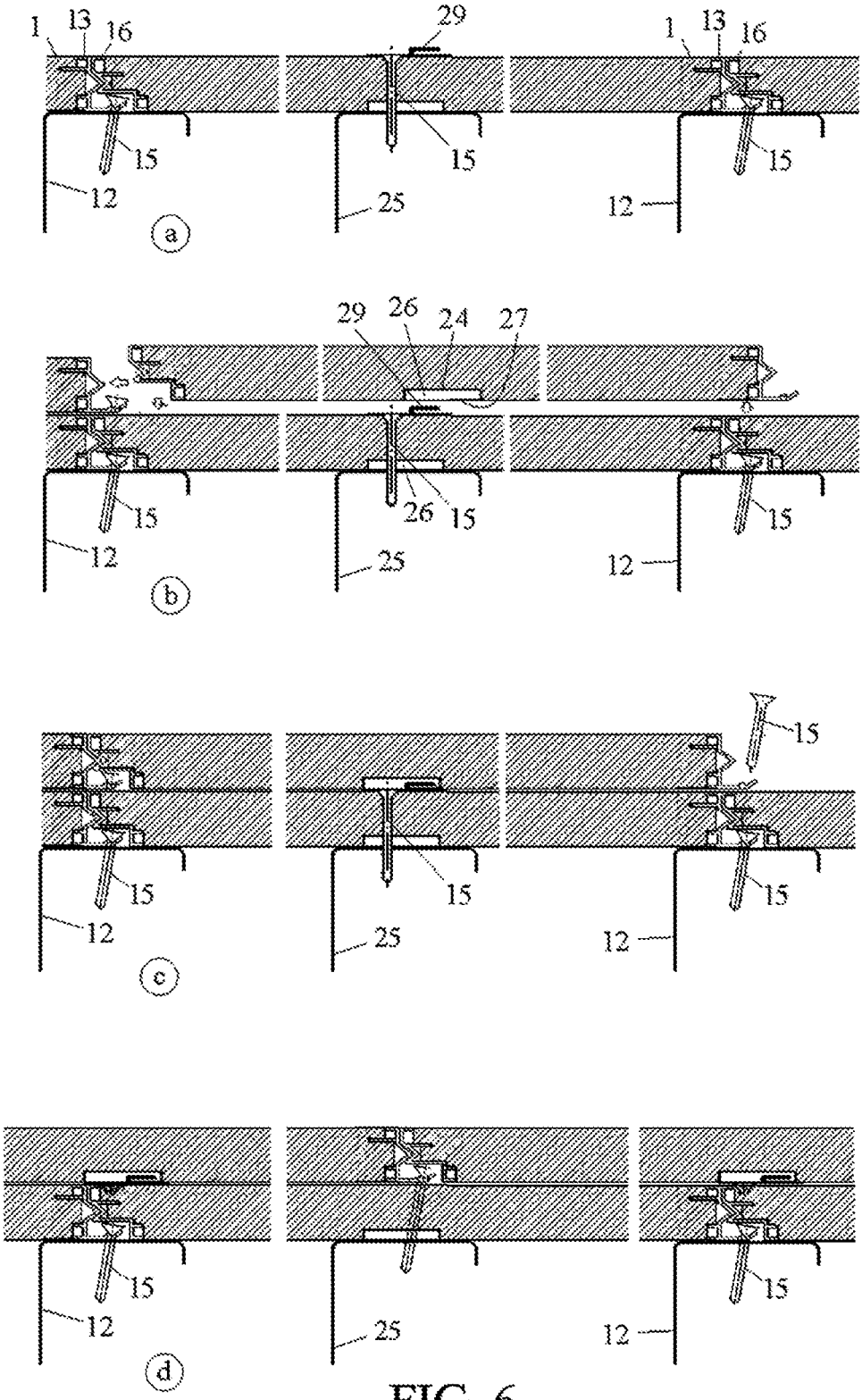
FIG. 6 shows, in cross-section, parts of neighbouring drywall panels provided with edge couplings shown in FIG. 4, wherein, however, a double layer of drywall panels is arranged against a background, the front drywall panels with the drywall panels behind it being coupled to a rear coupling of the same type as shown in FIG. 5.

FIG. 6 shows, in cross-section, parts of neighbouring drywall panels provided with edge couplings shown in FIG. 4, wherein, however, a double layer of drywall panels is arranged against a base or background, where the front drywall panel is coupled with a drywall panel behind it using a rear coupling 24-29 of the same type as shown in FIG. 5. In this configuration, a first layer of drywall panels is connected to the upright elements 12 and 25, where the coupling strip 29 is screwed down to the front surface (in the figure the top) of the rear (in the figure the bottom) drywall panel 1. The screws 15 used are screwed through the coupling strip 29, the rear drywall panel and the material of the intermediate upright element 25. Subsequently, the second layer of drywall panels is applied in substantially the same manner as illustrated in FIG. 5, wherein the edge coupling profiles 13 and 16 are coupled to each other after the securing extensions 4 have been secured to the edge upright elements 12, while by means of a transverse sliding movement not only the edge coupling profiles 13 and 16 are slid into each other, but also the rear coupling profile 24 of the outer (upper) drywall panel in the coupling strip 29 which was screwed down to (on top) the inner (lower) drywall panel.

It is noted that the drywall panels of the outer and the inner layer are preferably staggered with respect to each other, whereby, among other things, it is achieved that the fire-resistant properties of the wall formed by those drywall panels is still improved. This situation is illustrated in FIG. 6*d*.

Figure 7:
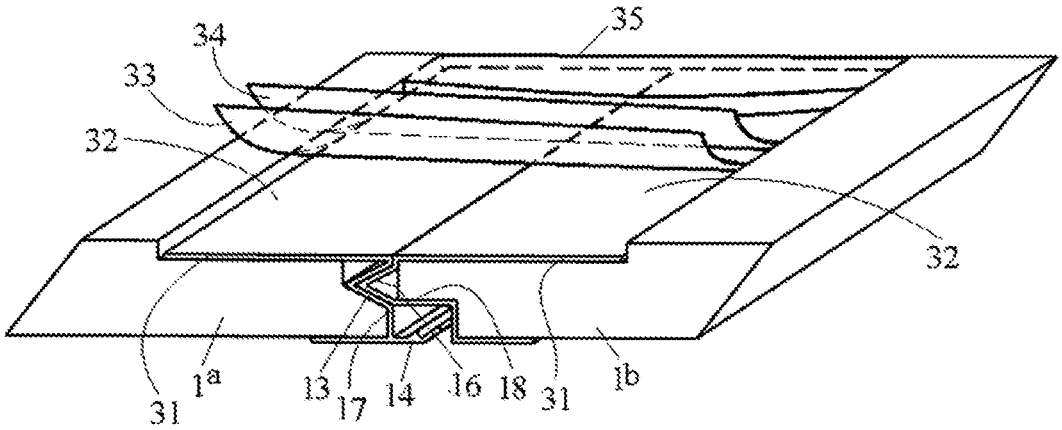
FIG. 7 shows, in cross-section, an embodiment of two cooperating edge coupling profiles which are provided with anti-adhesive edge extensions.

FIG. 7 shows, in cross-section, drywall panels 1 *a* and 1 *b* which are provided with edge coupling profiles 13/14 and 16 which, except for coupling together adjacent drywall panels 1 and for securing them—via a securing extension 14—and for instance screws (not shown here) down to a base or background such as the upright elements 12. In the embodiment shown in FIG. 7, the edge coupling profiles 13/14 and 16 are also provided with edge extensions 31, each forming an anti-adhesive edge area 32 on the front side of the relevant drywall panel having a surface of such material and/or having such surface condition that stucco mass used to smooth out the transitions between successive drywall panels does not adhere to them. This option forms part of a third (priority) patent application, NL1043126, filed on 21 Jan. 2019 by the applicant. The anti-adhesive edge areas 32 formed by those edge extensions 31 thus serve to ensure that the (edge) areas on either side of the seams between two adjacent drywall panels can be plastered evenly where, however, can be achieved that the applied stucco layer can be removed in a simple and clean way from the area above the edge coupling profiles 13/14 and 16 and the screws by which the securing extension 14 is attached to the background, after which the drywall panels can be properly dismantled (uncoupled and unscrewed) and subsequently reused instead of that the drywall panels would be damaged so that they would no longer be reusable as well functional drywall panels, and hence would have to be disposed then as gypsum waste.

Briefly, the anti-adhesive edge areas 32 are used, for example, as follows (for a more detailed description reference is made to the aforementioned prior patent application NL1043126 of the applicant):

a self-adhesive protective tape 33 (for example duct tape) is pasted over both anti-adhesive edge areas 32;

self-adhesive stucco tape 34 is then stuck over the protective tape 33;

the—usually mesh-shaped—stucco band 34 serves as a background and "reinforcement" of a layer of stucco mass 35 to be applied over it.

It is thus achieved that the stucco mass does not adhere to the drywall panel itself, i.e. to the rather vulnerable outer layers 8 (see FIGS. 1 and 3) of cardboard/paper and can therefore be removed without thereby damaging the drywall panels. The stucco layer 35 adheres only by means of the adhesive of the self-adhesive stucco tape 34 and that of the self-adhesive protective tape 33 to the anti-adhesive (i.e. non-adhesive for stucco mass) edge areas 32 whereby, when the drywall panels are to be dismantled again, the protective tape 33 plus the stucco band 34 and the (then hardened) stucco layer 35 of the drywall panels can be peeled off, after which the coupling profiles 13/14 and 16 will be exposed and accessible to be uncoupled from each other and to be unscrewed from the background, with the result that the drywall panels can be reused as such, while the environment is not burdened with waste originated by useless, damaged/destroyed drywall panels.

With regard to FIG. 7 it is further noted that the tongue and groove-like coupling shown therein is of a slightly different design than that in FIGS. 2 to 6: in the embodiment shown there the first (left) edge coupling profile 13 has a (coupling) groove, while the second (right) edge coupling profile 16 is provided with a (coupling) brass.

The invention claimed is:

1. A method for making a wall with the aid of drywall panels and a background, comprising:

providing drywall panels which are provided on their edges with edge coupling profiles, at one edge a first edge coupling profile having a securing extension, which is intended and arranged to be secured to the background, and on the other edge of the same drywall panel a second edge coupling profile, wherein the edge coupling profiles comprise coupling means which are arranged to be able to couple detachably the second edge coupling profile of a drywall panel and the first edge coupling profile of a drywall panel previously secured to the background the edge coupling profiles of the drywall panels comprise a first coupling means which are arranged to be able to couple detachably the second edge coupling profile of a drywall panel and the first edge coupling profile of a drywall panel previously secured to the background, by means of a hooking movement of a relevant drywall panel; and the edge coupling profiles of the drywall panels comprise a second coupling means which are arranged to be able to couple detachably the second edge coupling profile of a drywall panel and the first edge coupling profile of a drywall panel previously secured to the background, by means of displacement of the relevant drywall panel in a transverse direction;

subsequently, for making the wall, securing a first drywall panel against a background which is provided with the edge coupling profiles indicated above, wherein the first edge coupling profile of said first drywall panel is secured with its securing extension to the background, coupling together the second edge coupling profile of a second drywall panel and the first edge coupling profile of the first drywall panel, and subsequently, securing the securing extension of the first edge coupling profile of the second drywall panel to the background.

2. The method according to claim 1, wherein:

at least a part of said drywall panels is furthermore provided with at least one rear coupling profile which is arranged to be able to be coupled to a part of the background, and the rear coupling profile and the background are arranged to be coupled to each other by performing the same transverse displacement of the relevant drywall panel as with which the edge coupling profiles are coupled to each other.

3. A plurality of drywall panels, intended and arranged to make a wall to a background, wherein the drywall panel comprises:

edge coupling profiles at both edges of the drywall panel, the coupling profiles being arranged to be able to couple detachably adjacent drywall panels, wherein:

the edge coupling profiles of the drywall panels comprise a first coupling means which is arranged to be able to couple detachably a second edge coupling profile of a first drywall panel of the plurality of drywall panels and a first edge coupling profile of a second drywall panel of the plurality of drywall panels previously secured to a background to each other by means of a hooking movement of a relevant drywall panel;

the edge coupling profiles of the drywall panels further comprise a second coupling means which is arranged to be able to couple detachably the second edge coupling profile of the first drywall panel and the first edge coupling profile of the second drywall panel previously secured to the background to each other by means of displacement of the relevant drywall panel in transverse direction;

on one edge of a given drywall panel a first edge coupling profile having a securing extension intended and arranged to be secured to the background, on the other edge of the given drywall panel is positioned a second edge coupling profile;

the edge coupling profiles of the drywall panels further comprise anti-adhesive extensions, each of which forms an anti-adhesive edge area at a front side of the relevant drywall panel, with a surface to which stucco does not adhere.

4. The plurality of drywall panels according to claim 3, wherein at least one of the edge coupling profiles is arranged to be secured to the background by means of screws.

5. The plurality of drywall panels according to claim 4, wherein the securing extension is intended and arranged to be secured to the background by means of screws.

6. The plurality of drywall panels according to claim 3, wherein the first and second edge coupling profiles are at least partially applied to the edges of at least one of the drywall panels by gluing.

7. The plurality of drywall panels according to claim 6, provided on both surfaces with a protective layer, wherein the first and second edge coupling profiles are applied at least partly by gluing to inwardly folded edge strips of both protective layers.

8. The plurality of drywall panels according to claim 3, further comprising at least one rear coupling profile which is arranged to be able to be coupled to a part of the background and wherein the rear coupling profile and the background are arranged to be coupled to each other by performing the same transverse movement of the relevant drywall panel as with which the edge coupling profiles are coupled to each other.

9. The plurality of drywall panels according to claim 8, wherein said rear coupling profile is arranged in a slot recessed in a rear side of at least one of the drywall panels.

10. The plurality of drywall panels according to claim 8, wherein the rear coupling profile comprises a substantially U-, V- or C-shaped edge coupling profile comprising one or more coupling extensions extending substantially in or within the rear surface of the at least one of the drywall panels, inwardly into the slot, arranged to engage, directly or indirectly, to or in in a suitable part of the background.

* * * * *